United States Patent [19]

Daus

[11] 4,307,904

[45] Dec. 29, 1981

[54] LOCK MECHANISM

[75] Inventor: Ronald R. Daus, McKenzie, Tenn.

[73] Assignee: Republic Steel Corporation, Cleveland, Ohio

[21] Appl. No.: 113,107

[22] Filed: Jan. 17, 1980

[51] Int. Cl.[3] ..... E05B 65/06; E05B 67/38; E05C 1/04; E05C 13/02

[52] U.S. Cl. ..... 292/148; 60/56; 70/129

[58] Field of Search ..... 292/57, 104, 148, 151, 292/153, 175, 205; 70/54, 55, 56, 129

[56] References Cited

U.S. PATENT DOCUMENTS

| | | | |
|---|---|---|---|
| 139,767 | 5/1873 | Carlin | 292/148 |
| 145,131 | 12/1873 | Smith | 292/148 |
| 416,433 | 12/1889 | Wilson | 70/56 |
| 918,316 | 4/1909 | Harris | 292/153 |
| 1,047,315 | 12/1912 | Shone | 292/57 |
| 1,368,711 | 2/1921 | Foley | 292/148 |
| 3,374,020 | 3/1968 | Berg | 292/175 |
| 3,392,555 | 7/1968 | Beaver | 70/56 |
| 3,599,453 | 8/1971 | Bauernfeind | 70/129 |
| 3,953,062 | 4/1976 | Maston | 292/57 |
| 4,031,719 | 5/1977 | Klingler et al. | 70/56 |
| 4,068,505 | 1/1978 | Volk, Jr. | 70/56 |
| 4,125,281 | 11/1978 | Dean et al. | 292/148 |

*Primary Examiner*—Robert L. Wolfe
*Attorney, Agent, or Firm*—Emory L. Groff, Jr.

[57] ABSTRACT

A door latching assembly readily adaptable to a standard cylindrical lock provision includes a unitary bolt/handle member substantially shielded by a fixed cover with at least a portion of the handle confined within a retainer member which defines alternate positions of the bolt and establishes a slot with the cover to provide a guide for the handle. Mating lock receiving openings in the handle, retainer member and cover provide for the application of either one or two lock devices to immobilize the bolt in a door locking position. By the symmetrical formation or assembly of certain components and the selective positioning of the lock receiving openings, the mechanism of this invention may be alternately utilized in either a left-hand or right-hand door lock installation without any structural modification of the components.

15 Claims, 5 Drawing Figures

LOCK MECHANISM

This invention relates generally to security means and more particularly to an improved lock mechanism particularly useful for exterior doors requiring greater than usual security.

The present invention is particularly adaptable for employment in connection with the small, household size warehouse facilities which presently are quite popular throughout the country. These installations provide do-it-yourself facilities for persons requiring additional storage capabilities and each site will often include several hundred small enclosures, each provided with a single access protected by one door. Thus, it will be quite obvious that an extremely economical mechanism is most desirable for providing the maximum degree of security in the locking of these doors. The ideal lock mechanism in such a situation should be installable in the field and without any structural modification of the associated door or frame that is, the lock mechanism is preferably readily adaptable to doors supplied with a standard cylindrical lock provision. Additionally, means should be provided to permit both the renter as well as the landlord to apply their respective lock devices such as padlocks. With such padlocks in place, appropriate means must be included to provide security against unwarranted tampering with the lock mechanism as well as security against the weather.

The provision of lock devices particularly adapted for employment in an environment exposed to the elements is well known. U.S. Pat. Nos. 3,392,555 issued July 16, 1968, 4,031,719 issued June 28, 1977 and 4,068,505 issued Jan. 17, 1978 each disclose an example of a lock mechanism including shielding or cover means serving to provide some degree of protection for an applied padlock. The present invention however, offers an improved arrangement including a unitary bolt/handle assembly having shielded means for the reception of more than one padlock and which structure is symmetrically configured to accommodate either a left-hand or right-hand door installation without any structural modification of the components of the lock mechanism.

Accordingly, one of the objects of the present invention is to provide an improved lock mechanism including a reciprocating bolt disposed within the interior of a door and integral with a handle disposed outside the door and the handle includes lock receiving means cooperating with a bolt retainer member which is fixed relative the door and includes lock receiving means mating with the handle lock receiving means to immobilize the bolt.

A further object of the present invention is to provide an improved lock mechanism including a bolt/handle member having a handle portion disposed exteriorly of the door and which is substantially shielded by a cover containing a retainer member having a pair of vertical legs between which a portion of the handle reciprocates to extend and withdraw a bolt portion of the bolt/handle member which is disposed within the interior of the door.

Still another object of the present invention is to provide an improved lock mechanism including a handle disposed for reciprocation between a stationary shielded retainer member and outermost cover with a bolt projecting from the rear of the handle into the interior of a door through an exterior mounting plate which plate serves to rigidly mount the cover and retainer member upon the door.

Another object of the present invention is to provide an improved lock mechanism including a longitudinally extending handle mounted for horizontal reciprocation between a fixed cover and innermost bolt retainer member with a bolt attached to the rear of the handle and having a longitudinal section parallel to the handle and adapted to be retained in a closed position by the application of a lock device through mating juxtaposed openings in an end wall of the handle and a leg of the retainer member.

A further object of the present invention is to provide an improved lock mechanism for a door including a plurality of stationary elements adapted to be fixedly mounted upon a door and serving to support and house a shiftable bolt/handle assembly with at least a pair of openings through both the stationary and shiftable elements and wherein certain of the various elements and openings are symmetrically disposed to permit either a left-hand or right-hand installation of the lock mechanism without any modification of the elements.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawings.

Figure 1:
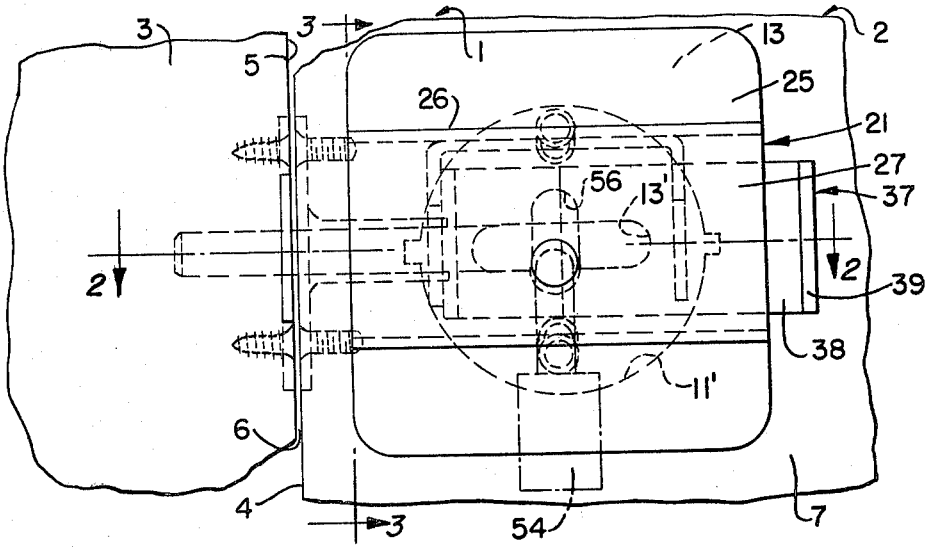
FIG. 1 is a fragmentary front elevation of the lock mechanism of the present invention.
Figure 2:
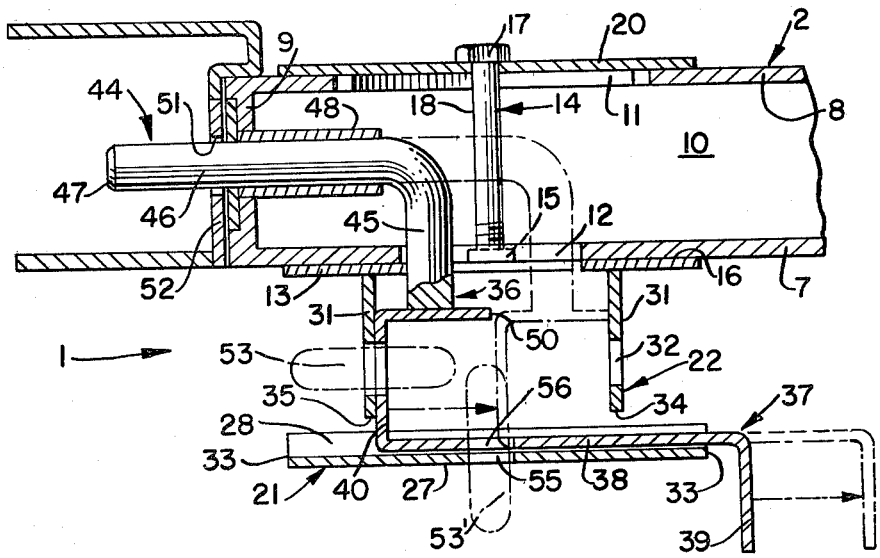
FIG. 2 is a horizontal sectional view taken along the line 2—2 of FIG. 1 and illustrating alternate positions of the bolt/handle assembly.
Figure 3:
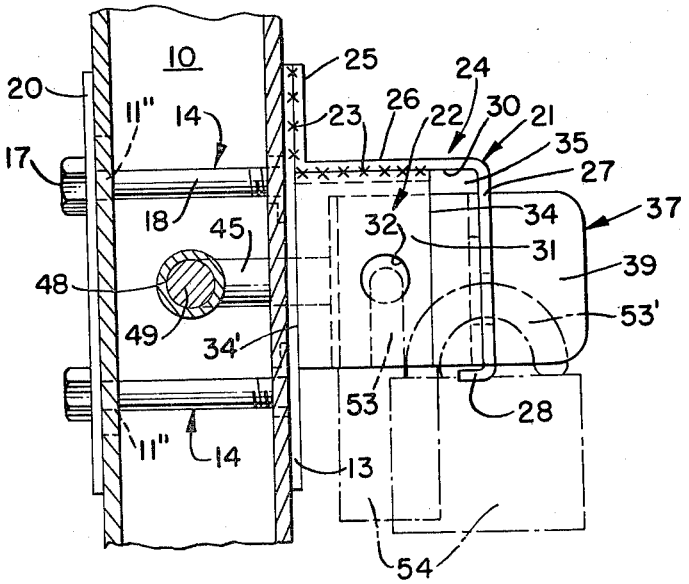
FIG. 3 is a vertical transverse sectional view taken along the line 3—3 of FIG. 1.
Figure 4:
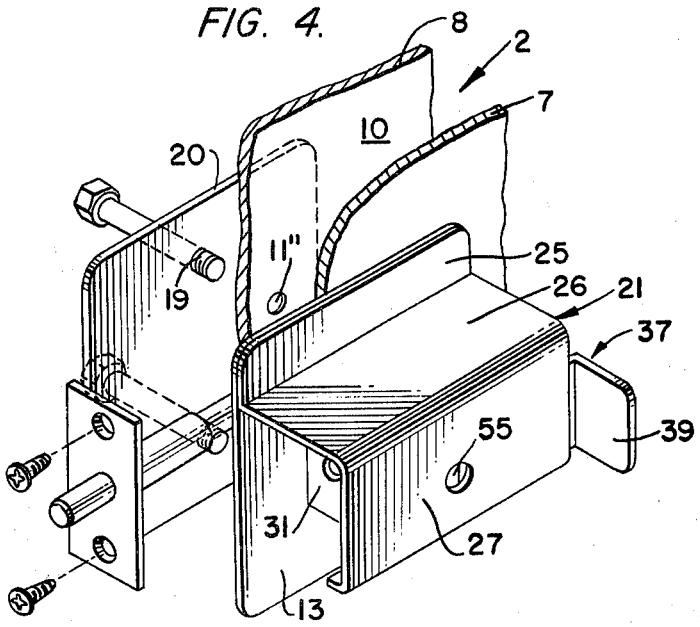
FIG. 4 is a perspective view illustrating the various components of the lock mechanism of the present invention.
Figure 5:
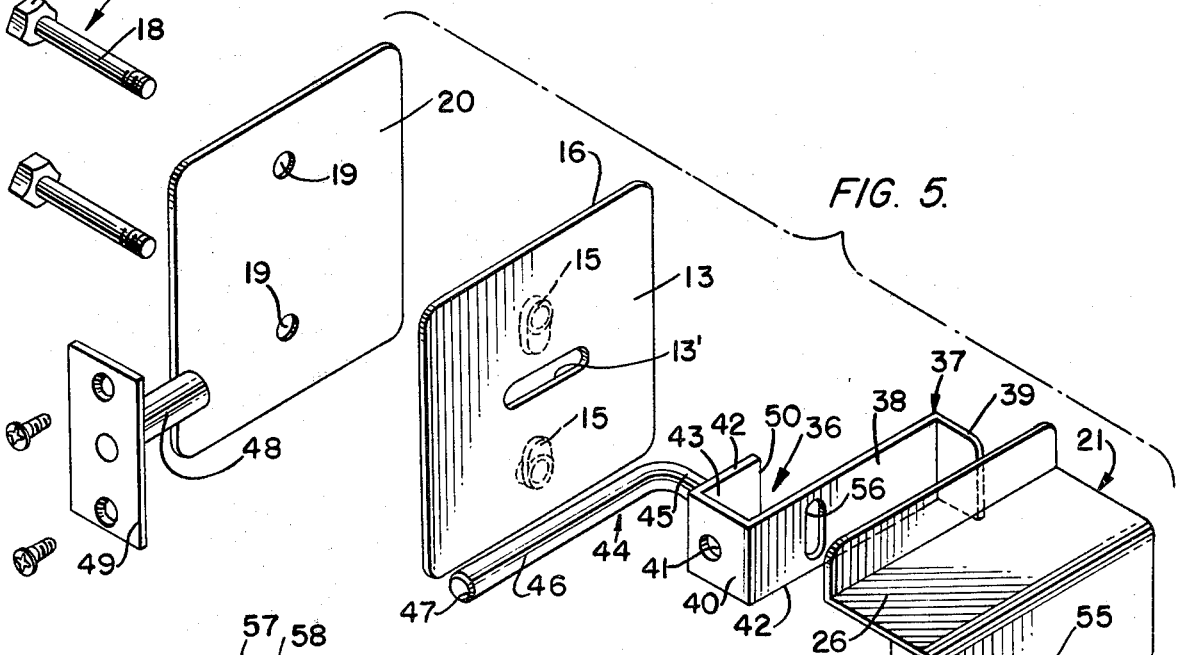
FIG. 5 is an exploded perspective view of the lock mechanism components of FIG. 4.

Referring now to the drawings, particularly FIGS. 1–3, the present invention will be seen to comprise a lock mechanism generally designated 1, which may most readily be applied to secure a door 2 in a locked position with respect to an adjacent frame 3. The lock device is primarily intended to be employed in combination with a swinging door 2 and in such and installation, will be located adjacent the door edge 4 which is parallel to the opposite door edge serving as a mount for appropriate hinge means (not shown). Quite obviously, the lock mechanism of the instant invention may be utilized in combination with other types of doors such as overhead rolling doors. Thus the mechanism may be used at any time it is desired to preclude movement between a door edge 4 and an adjacent frame edge 5 so as to maintain a door opening 6 in a sealed off manner by means of the door 2.

For maximum security the door 2 is preferably constructed of metal and includes as in the embodiment of FIGS. 1–5, an outer or exterior panel 7 and an inner or interior panel 8 spaced apart by suitable intermediate members such as the edge channel 9. Appropriate reinforcing elements or a filler composition may be disposed between the spaced apart panels 7 and 8 however, the area juxtaposed the desired location of the lock mechanism 1 is purposely left clear between the door panels to provide the hollow interior 10. As previously mentioned, the lock mechanism 1 is most readily installed in a door that is already supplied with a standard cylindrical lock provision, that is, includes $2\frac{1}{8}''$ openings in the exterior and interior panels and a bolt opening in the edge channel. Quite obviously, the present mechanism may be installed in doors not thusly supplied and accordingly, FIGS. 1 and 2 illustrate both methods of installation with the interior panel 8 being supplied with a large cylindrical opening while this standard lock provision opening is omitted from the exterior panel 7.

The door 2 is readily prepared for the attachment of the lock mechanism 1 of the present invention by the relatively simple procedure of providing a pair of aligned mounting openings 11 or 11' through the door panels 8 and 7.

In a door already supplied with the standard cylindrical lock provision each panel will be understood to include an opening 11 shown in the interior panel 8 and with such openings in both panels 7 and 8 it will be appreciated that clearance will be provided for attaching the lock mechanism to the door and for the reciprocating displacement of the bolt, without any modification of the door panels 7–8. In the case of a door not already supplied with a pair of the enlarged openings 11 the installer may either provide two such openings 11 or alternately, two pairs of smaller holes 11''—11'' through both panels 7–8 indicated by 11'' in FIGS. 3 and 4. In this latter instance it will be necessary to additionally form a longitudinally disposed slot 12 through the exterior panel 7. This slot 12 is formed with its major axis perpendicular to the adjacent door edge 4 and the two pairs of holes 11''—11'' formed in each door panel are preferably equal distances from the slot 12 and disposed upon a line passing through the center of this slot for reasons which will become obvious hereinafter.

Substantially the entire lock mechanism is supported by means of an exterior mounting plate 13 which engages the outer surface of the exterior panel 7 and is fixedly retained thereagainst by means of attachment means comprising a pair of machine screws engaging weld nuts 15 attached to the rear surface 16 of the exterior mounting plate 13 and which will be seen to pass through the openings 11 or holes 11'' of the two panels 7 and 8. As will be seen most clearly in FIGS. 2 and 5 of the drawings, the machine screws 14 include a head 17 and a shank 18 which is of a length sufficient to pass through both holes 19 in an interior mounting plate 20 as well as through the door interior 10 to the weld nuts 15 affixed to the exterior mounting plate 13. By appropriately tightening the screws 14 from the interior of the door it will be seen that the two mounting plates 13 and 20 will be secured in a fixed manner as shown in FIGS. 1–3 of the drawings, it being noted that in this position, all fasteners or attachment means are shielded from view to one located on the outside of the door 2 and this inaccessability resists efforts of one inclined to tamper with the present invention.

Rigidly secured to the exterior mounting plate 13, in a manner insuring the formation of a fixed assembly, is the cover 21 having in turn a bolt retainer member 22 similarly affixed thereto. Welding, as at 23 in FIG. 3 of the drawings, is the most appropriate manner of providing this attachment and insures a unitary fixed assembly 24 comprising the exterior mounting plate 13, cover 21 and bolt retainer member 22.

The cover 21 will be seen to additionally serve as a shield to at least partially mask the retainer member 22 and other components of the lock mechanism. This cover includes a vertically disposed attachment flange 25 which is connected such as by the weld 23 to the upper portion of the exterior mounting plate 13 and includes a top wall 26 horizontally projecting outwardly from the bottom thereof and which in turn, is joined to a vertically disposed front wall 27 extending downwardly and terminating in an in-turned bottom flange 28 as shown most clearly in FIGS. 3–6 of the drawings.

The aforementioned bolt retainer member 22 includes a horizontally disposed base 29 which is secured to the undersurface 30 of the cover top wall 26 by the welds 23 and includes a pair of depending congruent, spaced apart legs 31—31. Each of the legs 31 is provided with a lock receiving opening 32 which are formed so that the two openings 32—32 are axially aligned. As shown most clearly in FIG. 2 of the drawings, the length of the base 29 of the bolt retainer member 22 is substantially less than the length of the cover 21 such that the two legs 31—31 will be seen to be spaced well inwardly from the lateral edges 33—33 of the cover for reasons which will become obvious hereinafter. A further important feature regarding the relative disposition between the components of the fixed assembly 24 resides in the positioning of the forward edge 34 of the bolt retainer member 22 at a point spaced slightly rearwardly of the cover front wall 27 so as to provide the horizontal slot 35 having its top restricted by the cover top wall 26 and its bottom defined by the in-turned bottom flange 28 of the cover. With the rear edge 34' of the retainer member 22 disposed flush with the exterior mounting plate 13 as viewed in FIG. 3, it will be observed that the off-center disposition of the two openings 32, toward the forward edge 34, results in the positioning of the center of these openings substantially mid-way of the cover front wall 27 and exterior mounting plate 13.

The aforedescribed fixed assembly 24 is intended to accomplish several purposes. The wide extent of the cover 21 serves to shield the majority of a bolt/handle assembly 36 against, not only the elements of the weather, but also against tampering. Additionally, the cover will be seen to cooperate with the other components to provide protection for one or more applied lock devices, such as padlocks, which are intended to be used to secure the lock mechanism in its locked condition.

The bolt/handle assembly 36 includes a handle 37 provided with a longitudinally extending front wall 38 communicating at one end with the hand-hold or grip 39 disposed normal to the front wall 38. Disposed normal to the opposite end of the front wall 38 and projecting in the opposite direction therefrom, is an end wall 40 which will be seen to be provided with a single lock receiving opening 41, which opening is equispaced from the respective adjacent horizontal edges 42 of the handle 37. The handle end wall 40 in turn communicates with a rear wall 43 disposed parallel to the front wall 38 and of a horizontal length substantially less than that of the spaced apart cover front wall 38. Rigidly attached to the rear surface of the handle rear wall 43 is the bolt 44 which includes an offset section 45 extending from the rear wall 43 normal thereto and which is joined at right angles to the longer, longitudinal section 46 which terminates in the chamfered nose 47.

The assembly of the above described components of the lock mechanism 1 will now be described. The external mounting plate 13 includes the horizontally disposed longitudinal bolt slot 13' centrally disposed intermediate the two weld nuts 15—15 such that this bolt slot 13' overlies the underlying panel opening 11' or slot 12 in the door exterior panel 7. During the assembly of the lock mechanism 1, the longitudinal section 46 of the bolt/handle member 36 is disposed through these two slots or openings and following insertion into the interior 10 of the door 2, the nose 47 is slidably anchored by means of a sleeve 48 affixed to an appropriate latch front 49 that is suitably attached to the door edge channel 9.

When mounted as above, the bolt/handle assembly 36 will be positioned with the longitudinally extending front wall 38 of the handle 37 located in the horizontal slot 35 between the cover front wall 27 and forward edge 34 of the bolt retainer member 22. With the hand-hold grip 39 of the handle 37 projecting forwardly beyond one of the lateral edges 33 of the cover 21 it will be seen that the handle 37 will have a portion of its front wall 38 and all of its end wall 40 and rear wall 43 at all times held captive within the confines of the legs 31—31 of the bolt retainer member 22, as shown most clearly in FIG. 2 of the drawings, wherein the alternate positions of the handle 37 are shown in full and dotted lines.

The configuration of the elements of the bolt/handle assembly 36 insure the above described operation. The depth or width of the slot 35 is selected to allow for the free sliding movement of the handle front wall 38 and the resultant captive retention of this front wall within the slot 35 at all times retains the handle rear wall 43 in a single vertical plane such that when shifted to the extreme right-hand direction its free edge 50 will abut the rear portion of the right-hand leg 31 of the bolt retainer member 22 as shown in FIG. 2 of the drawings. The two limits of travel of the bolt/handle assembly 36 in turn define the limits of rectilinear displacement of the nose 47 of the bolt 44. When the hand-hold 39 is horizontally displaced to its full right-hand extreme the bolt nose 47 will be seen to be disposed to the right of the outer surface of the latch front 49 carried by the door edge channel 9 so that the door 2 may be opened.

Alternately, when the grip 39 is displaced to the limits of its left-hand direction, the bolt nose will be shifted as shown in full lines in FIG. 2 wherein it is projected well beyond the latch front 49 and into the bore 51 of an appropriate keeper 52 suitably mounted within the adjacent door frame 3. When disposed in this latter, locked position the end wall 40 of the handle 37 abuts the left-hand leg 31 of the bolt retainer member 22 and the lock receiving opening 41 in this end wall 40 is aligned with or overlying the single juxtaposed lock receiving opening 32 through the leg 31.

The above arrangement allows for the application of the shackle 53 of an appropriate lock device such as the padlock 54 through the juxtaposed openings 32, 41 thereby retaining the bolt/handle assembly 36 in this locked position. As shown in FIGS. 2 and 3 of the drawings, the thus applied lock device 54 is disposed beneath the cover 21 and its shackle 53 is entirely disposed within the confines of the cover 21, due to the horizontal projection of the lateral edges 33 of the cover. This arrangement allows a renter to apply his own lock to the lock mechanism 1 of the present invention in a manner which will insure the maximum degree of security against unwarranted tampering as well as the maximum protection against the weather.

Provision is also made for the application of a second lock, such as by the landlord. The front wall 27 of the cover 21 is provided with a single lock receiving opening 55 which is centrally located with respect to the lateral edges 33—33 of the cover. This opening 55 cooperates with a single lock receiving opening 56 formed in the handle front wall 38 at a point selected to insure alignment of the two openings 55 and 56 when the handle 37 is in the left-hand or locked position as shown in FIG. 2. With the application of the shackle 53' of a second lock device as shown in FIG. 2 of the drawings, it will be obvious that substantial additional security will thus be provided.

The formation of various components of the lock mechanism 1 in a symmetrical manner provides the important convenience of being able to apply this same lock mechanism 1 to either a left-hand or right-hand hinged door installation. As previously mentioned: the bolt slot 13' in the exterior mounting plate 13 is centrally and medially disposed with respect to the two machine screws 14—14 and weld nuts 15—15; the bolt retainer member 22 is centrally disposed with respect to the longitudinal extent of the cover 21; the lock receiving openings 32 in the retainer member legs 31 are substantially medially disposed between the cover wall 27 and exterior mounting plate 13 and the lock receiving opening 55 in the front wall 27 of the cover is medially disposed with respect to the two lateral edges 33—33 thereof. With this construction, the lock mechanism as illustrated in a right-hand hinge installation may be readily converted to a left-hand hinge installation by utilizing the same mounting plates 13 and 20 together with the fixed assembly 24 merely by reversing the bolt handle assembly 36 180° . With such a reversal the right-hand leg 31 of the bolt retainer member 22 and its lock receiving opening 32 would be employed in cooperation with the same single lock receiving opening 41 on the bolt handle end wall 40. The same lock receiving openings 55 and 56 that were aligned with one another to provide means for the reception of the landlord's shackle member 53' will still be in alignment when the lock mechanism is employed in a left-hand installation in view of the medial disposition of the opening 55 in the cover 21.

Figure 6:
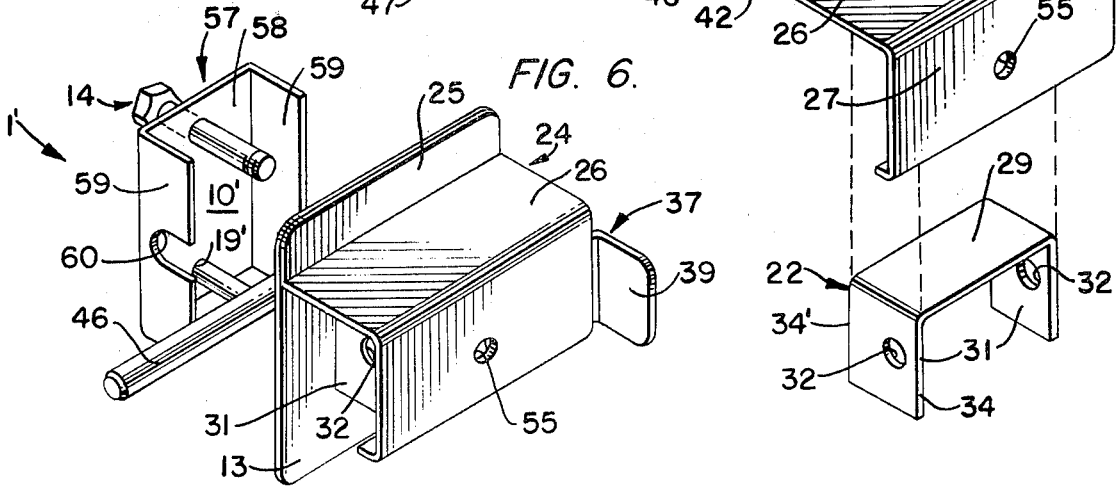
FIG. 6 is a perspective view similar to FIG. 4 and illustrates a modification adaptable to doors having only an outer panel.

The embodiment illustrated in FIG. 6 of the drawings relates to an alternative lock mechanism 1' applicable to an installation wherein the door does not include an interior panel 8. The mechanism 1' is similar to the previously described mechanism 1 from the bolt/handle assembly 36 outwardly with the bolt longitudinal section 46 intended to be disposed behind a door exterior panel and the exterior mounting plate 13 flushly retained against the outside or face of such an exterior panel just as in the first described embodiment. Since no interior panel 8 is employed, separate interior mounting means comprising an interior mounting bracket, generally designated 57, is provided. This bracket includes an interior plate 58 provided with holes 19'—19' for the reception of the machine screws 14 and a pair of side walls 59—59 engageable with the inside surface of the exterior panel 7 and defining a hollow interior 10' therebetween. One of the side walls 59 is provided with a cut-out 60 adapted to straddle the bolt longitudinal section 46 while the bolt offset section 45 will be understood to remain within the confines of the interior space 10' during its reciprocation between its limits of travel.

From the foregoing it will be seen that an improved lock mechanism is provided for ready attachment to either a left-hand or right-hand hinged door installation with means included to permit mounting in either a single or spaced apart, double panel door.

I claim:

1. A lock mechanism for a door having an exterior panel joined to an edge channel including, an interior mounting plate rearwardly spaced from said exterior panel, planar exterior mounting means fixed adjacent the outer face of said exterior panel adjacent said edge channel, a cover having a top wall secured relative said exterior mounting means and provided with a front wall spaced from said exterior panel and exterior mounting means, a bolt/handle assembly disposed substantially intermediate said cover front wall and door edge channel, said bolt/handle assembly including a handle rigidly secured to an elongated bolt, said handle disposed between said cover front wall and exterior panel, said exterior panel provided with an opening behind said cover front wall, said bolt including a longitudinal section at least partially located between said spaced apart exterior panel and interior mounting plate and slidably disposed for axial movement through said edge channel, said bolt longitudinal section connected to an offset section extending through said exterior panel opening and joined to said handle, a retainer member secured to said cover and having a leg behind said cover front wall, said leg provided with a lock receiving opening, said handle including an end wall behind said cover front wall and having a lock receiving opening therethrough alignable with said retainer member opening whereby, displacement of said handle in one direction juxtapositions said two lock receiving openings with said bolt longitudinal section extended through said edge channel.

2. A lock mechanism according to claim 1 wherein, said planar exterior mounting means includes a mounting plate intermediate said cover and exterior panel, fastener components projecting rearwardly from said exterior mounting plate and extending through at least said exterior panel and said exterior mounting plate includes an opening communicating with said exterior panel opening.

3. A lock mechanism according to claim 1 wherein, said handle includes a front wall disposed behind said cover front wall, said handle front wall having one end joined to said end wall and another end projecting from behind said cover front wall, and hand grip means on said other end of said handle front wall.

4. A lock mechanism according to claim 1 including, a front wall on said handle disposed behind and juxtaposed said cover front wall, a lock receiving opening through said cover front wall, a lock receiving opening through said handle front wall whereby, when said handle is displaced to juxtaposition said end wall and retainer leg openings said handle front wall and cover front wall openings are likewise juxtapositioned.

5. A lock mechanism according to claim 1 wherein, said handle includes a rear wall joined to said end wall, said bolt offset section connected to said rear wall, said retainer member having a pair of said legs disposed normal to said exterior panel, and said handle end and rear walls disposed between said pair of legs.

6. A lock mechanism according to claim 1 wherein, said door includes an interior panel spaced from said exterior panel and said interior mounting plate engages the rear surface of said interior panel.

7. A lock mechanism according to claim 1 wherein, said interior mounting plate is parallel to said exterior panel and includes a pair of side walls extending forwardly to engage said exterior panel.

8. A lock mechanism according to claim 2 wherein, said fastener components comprise weld nuts carried by said exterior mounting plate, and machine screws disposed through said interior mounting plate and engaging said weld nuts.

9. A lock mechanism according to claim 2 wherein, said exterior mounting plate opening is centrally disposed relative the vertical and horizontal extent of said mounting plate.

10. A lock mechanism according to claim 3 wherein, said retainer member includes a pair of said legs, said legs spaced rearwardly of said cover front wall to provide a pair of horizontally aligned slots therebetween, and said handle end wall disposed between said pair of legs with said handle front wall extending through one of said slots.

11. A lock mechanism according to claim 4 wherein, said retainer member includes a pair of said legs, said legs horizontally symmetrically disposed relative said cover and exterior mounting means, and said cover opening is horizontally centrally disposed through said cover front wall whereby, said bolt/handle assembly may be reversed 180° to alternately accommodate left or right-hand operating doors with said handle front wall and cover front wall openings being aligned when said handle end wall is juxtaposed either one of said retainer member legs.

12. A lock mechanism according to claim 5 wherein, said retainer member legs are symmetrically disposed relative said cover front wall horizontal extent whereby, said bolt/handle assembly may be reversed 180° to alternately accommodate left or right-hand operating doors with said handle end wall opening alternately juxtaposed either one of said retainer member legs.

13. A lock mechanism according to claim 5 wherein, said retainer legs are similarly configured and both said legs include one of said openings.

14. A lock mechanism according to claim 11 wherein, said retainer legs are similarly configured and both said legs include one of said openings.

15. A lock mechanism according to claim 12 wherein, said retainer legs are similarly configured and both said legs include one of said openings.

* * * * *